US009014583B2

(12) United States Patent
Aikawa

(10) Patent No.: US 9,014,583 B2
(45) Date of Patent: Apr. 21, 2015

(54) IMAGE FORMING APPARATUS FOR DECIDING A MAGNETIC TONER AMOUNT ON THE BASIS OF AN OUTPUT VALUE AND A STANDARD VALUE

(71) Applicant: KYOCERA Document Solutions Inc., Osaka (JP)

(72) Inventor: Yukihiro Aikawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/045,665

(22) Filed: Oct. 3, 2013

(65) Prior Publication Data

US 2014/0099134 A1 Apr. 10, 2014

(30) Foreign Application Priority Data

Oct. 9, 2012 (JP) ..... 2012-223951

(51) Int. Cl.
*G03G 15/09* (2006.01)
*G03G 15/08* (2006.01)

(52) U.S. Cl.
CPC ..... *G03G 15/0829* (2013.01); *G03G 15/0853* (2013.01)

(58) Field of Classification Search
CPC ..... G03G 15/0853; G03G 15/0829
USPC ..... 399/63
See application file for complete search history.

(56) References Cited

FOREIGN PATENT DOCUMENTS

JP 09-114218 A 5/1997
JP 2013105037 A * 5/2013

* cited by examiner

*Primary Examiner* — Susan Lee
(74) *Attorney, Agent, or Firm* — Studebaker & Brackett PC

(57) ABSTRACT

In an image forming apparatus, the magnetic sensor obtains an output value varying with a magnetic toner amount in a development device. The correlative data storing part prestores correlative data relating to the output value when there is no magnetic toner in the development device and the output value when the magnetic toner amount is a predetermined setting value. The standard value storing part prestores an initial value of a standard value being the output value when the magnetic toner amount is the setting value. The standard value setting part makes the standard value storing part store the output value corresponding to the magnetic toner amount being the setting value, as new standard value, by the output value when there is no magnetic toner in the development device and the correlative data. The toner amount deciding part decides the magnetic toner amount by the output value and the standard value.

10 Claims, 8 Drawing Sheets

IMAGE FORMING APPARATUS FOR DECIDING A MAGNETIC TONER AMOUNT ON THE BASIS OF AN OUTPUT VALUE AND A STANDARD VALUE

INCORPORATION BY REFERENCE

This application is based on and claims the benefit of priority from Japanese Patent application No. 2012-223951 filed on Oct. 9, 2012, the entire contents of which are incorporated herein by reference.

BACKGROUND

The present disclosure relates to an image forming apparatus developing an electrostatic latent image by using a magnetic toner.

In an image forming apparatus using a magnetic toner for development of an electrostatic latent image, if an amount of a magnetic toner in a development device is small, an amount of the magnetic toner supplied to the electrostatic latent image becomes insufficient and an image is blurred. On the other hand, if the amount of the magnetic toner in the development device is large, when the magnetic toner is agitated and the magnetic toner is charged, electro static charge of the magnetic toner becomes insufficient. Either case causes degradation of image quality. Therefore, by utilizing a magnetic sensor, the amount of the magnetic toner in the development device is controlled by the predetermined value.

In a technique suggested as an example of controlling the amount of the magnetic toner in the development device, the magnetic toner is replenished to the development device continuously for a predetermined time before controlling image density. In accordance with an output value of the magnetic sensor before the replenished magnetic toner reaches the magnetic sensor and an output value of the magnetic sensor when the supplied magnetic toner reaches the magnetic sensor, a correcting time to a predetermined toner replenishing time is determined.

However, even if the magnetic sensors are the same product, dispersion of the output values inevitably occurs according to individual products. Therefore, if the amount of the magnetic toner in the development device is controlled by utilizing that the amount of the magnetic toner in the development device becomes a predetermined setting value when the output value outputted from the magnetic sensor is a predetermined value, it is necessary to adjust the output value for each magnetic sensor.

For the magnetic sensor, there are various manners. Among these, a differential transformer-type magnetic sensor is a permeability detecting-type sensor and comprises a drive coil, a detection coil and a standard coil. In a case of the differential transformer-type magnetic sensor having a structure that the drive coil, detection coil and standard coil are arranged in a core, it is possible to adjust the output value by adjusting a position of the core.

On the other hand, in a case of the differential transformer-type magnetic sensor having a structure that the drive coil, detection coil and standard coil as a plane coil are formed on a print substrate, the core is not provided, and therefore, it is regarded that the output value is adjusted by using an amplifier.

In both case, it is necessary to adjust the output value for each magnetic sensor, and accordingly, trouble occurs.

SUMMARY

In accordance with an embodiment of the present disclosure, an image forming apparatus includes an image forming part, a magnetic sensor, a correlative data storing part, a standard value storing part, a standard value setting part and a toner amount deciding part. The image forming part includes a development device containing a magnetic toner. The image forming part supplies the magnetic toner from the development device to an electrostatic latent image to form a toner image and forms the toner image on the sheet. The magnetic sensor obtains an output value varying in accordance with a magnetic toner amount in the development device. The correlative data storing part prestores correlative data indicating a relationship of the output value outputted by the magnetic sensor when there is no magnetic toner in the development device and the output value outputted by the magnetic sensor when the magnetic toner amount in the development device is a predetermined setting value. The standard value storing part prestores an initial value of a standard value being the output value outputted by the magnetic sensor when the magnetic toner amount in the development device is the setting value. The standard value setting part makes the standard value storing part store the output value of the magnetic sensor corresponding to the magnetic toner amount being the setting value, as new standard value, on the basis of the output value outputted by the magnetic sensor when there is no magnetic toner in the development device and the correlative data. The toner amount deciding part decides the magnetic toner amount in the development device on the basis of the output value of the magnetic sensor and the standard value.

In accordance with another embodiment of the present disclosure, an image forming apparatus includes an image forming part, a magnetic sensor, a correlative data storing part, a standard value storing part, a standard value setting part and a toner amount deciding part. The image forming part includes a development device containing a magnetic toner. The image forming part supplies the magnetic toner from the development device to an electrostatic latent image to form a toner image and forms the toner image on the sheet. The magnetic sensor obtains an output value varying in accordance with to a magnetic toner amount in the development device. The correlative data storing part prestores correlative data indicating a relationship of the output value outputted by the magnetic sensor when there is no magnetic toner in the development device and the output value outputted by the magnetic sensor when the magnetic toner amount in the development device is a predetermined setting value. The standard value storing part prestores an initial value of a zero standard value being the output value outputted by the magnetic sensor when there is no magnetic toner in the development device. The standard value setting part makes the standard value storing part store, as a new zero standard value, the output value outputted by the magnetic sensor when there is no magnetic toner in the development device. The toner amount deciding part determines the standard value as the output value of the magnetic sensor corresponding to the magnetic toner amount being the setting value, about a case of the new zero standard value, by using the correlative data, and decides the magnetic toner amount in the development device on the basis of the output value of the magnetic sensor and the standard value.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
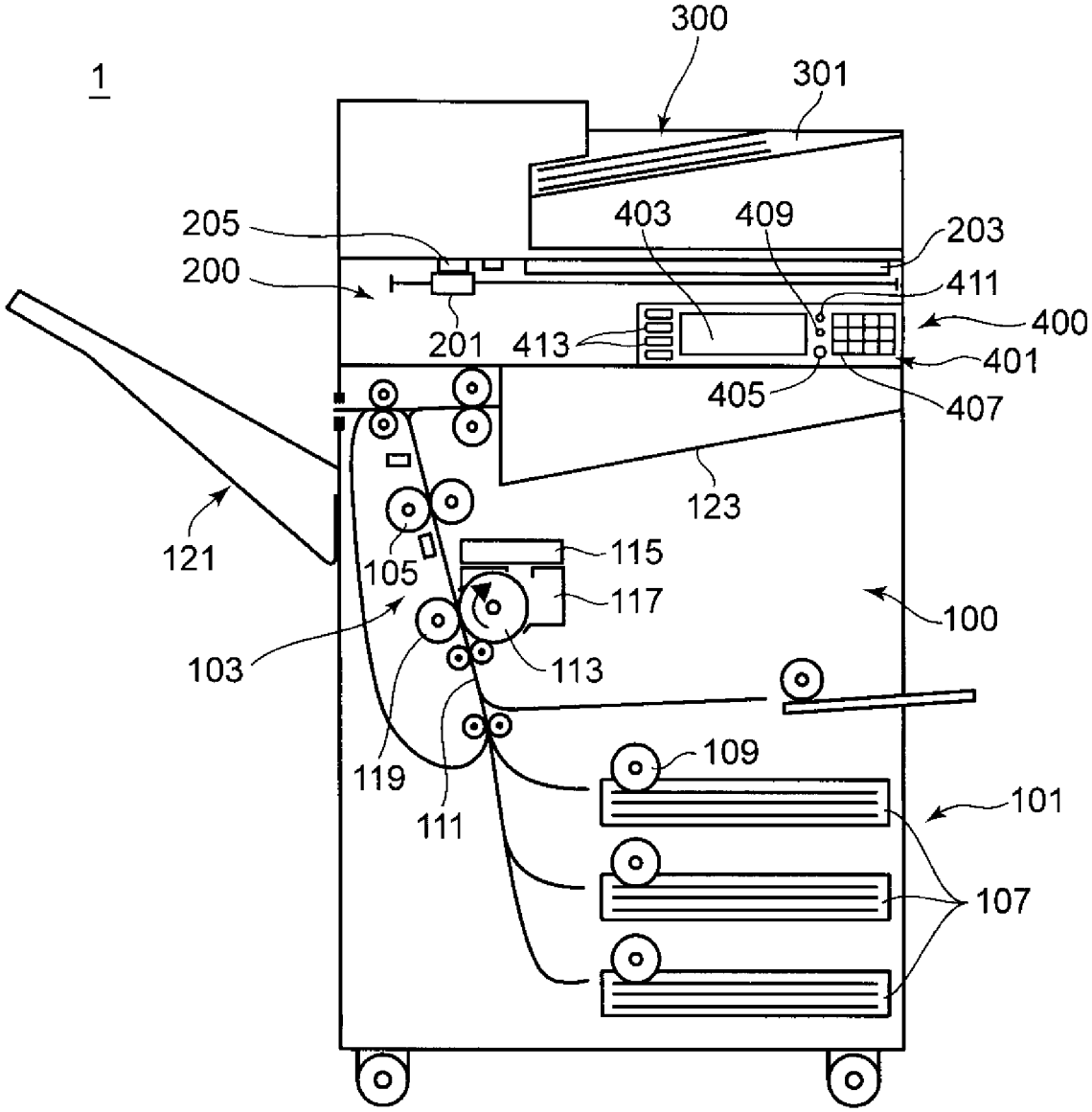
FIG. 1 is a schematic view schematically showing an internal configuration of an image forming apparatus according to an embodiment of the present disclosure.

In the following, an embodiment of the present disclosure will be described with reference to the drawings in detail. FIG. 1 is a schematic view schematically showing an internal configuration of an image forming apparatus 1 according to the embodiment of the present disclosure. The image forming apparatus 1 may be applied, for example, to a digital multi-function peripheral having functions as a copy, a printer, a scanner and a facsimile. The image forming apparatus 1 comprises an apparatus main body 100, a document reading part 200 located above the apparatus main body 100, a document feeding part 300 located above the document reading part 200 and an operating part 400 located at a front face of an upper part of the apparatus main body 100.

The document feeding part 300 functions as an automatic document feeding device and can feed a plurality of documents placed on a document placement part 301 so that the document reading part 200 can continuously read them.

The document reading part 200 includes a carriage 201 in which an exposure lamp and others are installed, a document platen 203 composed of a transparent member, such as a glass, a CCD (Charge Coupled Device) sensor (not shown) and a document reading slit 205. When the document placed on the document platen 203 is read, the document is read by the CCD sensor during the carriage 201 is moved in the longitudinal direction of the document platen 203. By contrast, when the document fed from the document feeding part 300 is read, the carriage 201 is moved at a position facing to the document reading slit 205 and the document fed from the document feeding part 300 is read by the CCD sensor through the document reading slit 205. The CCD sensor outputs the read document as image data.

The apparatus main body 100 includes a sheet storing part 101, an image forming part 103 and a fixing part 105. The sheet storing part 101 is located at a lowest part of the apparatus main body 100 and includes a sheet tray 107 being capable to store a bundle of sheets. In the bundle of the sheets stored on the sheet tray 107, an uppermost sheet is sent to a sheet conveying path 111 by drive of a pickup roller 109. The sheet is conveyed to the image forming part 103 through the sheet conveying path 111.

The image forming part 103 forms a toner image on the conveyed sheet. The image forming part 103 includes a photosensitive drum 113, an exposure part 115, a development device 117 and a transferring part 119. The exposure part 115 generates a light modulated in correspondence with the image data (such as image data outputted from the document reading part 200, image data transmitted from a personal computer or image data received by a facsimile) to irradiate a circumference face of the uniformly charged photosensitive drum 113. Thereby, on the circumference face of the photosensitive drum 113, an electrostatic latent image corresponding to the image data is formed. In such a state, by supplying a toner from the development device 117 to the circumference face of the photosensitive drum 113, the toner image corresponding to the image data is formed on the circumference face. The toner image is transferred to the sheet conveyed from the above-mentioned sheet storing part 101 by the transferring part 119.

The sheet having the transferred toner image is conveyed to the fixing part 105. In the fixing part 105, heat and pressure are applied to the toner image and sheet, and then, the toner image is fixed on the sheet. The sheet is ejected to a stack tray 121 or an ejection tray 123. As mentioned above, the image forming apparatus 1 prints a monochrome image.

The operating part 400 includes an operation key part 401 and a display part 403. The display part 403 has a touch panel function to display a picture including soft-keys (an input part configured by software). A user manipulates the soft-keys during looking at the picture, thereby inputting necessary setting for executing the function, such as the copy.

The operation key part 401 is provided with operation keys including hard-keys (another input part configured by hardware). Concretely, a start key 405, numeric keys 407, a stop key 409, a reset key 411, function switching keys 413 switching the copy, printer, scanner and facsimile are arranged.

The start key 405 is a key for starting the action, such as the copy and facsimile transmission. The numeric keys are keys for inputting numerals, such as the number of the copies and a facsimile number. The stop key 409 is a key for stopping the action, such as the copy, in the middle. The reset key 411 is a key for resetting set contents to an initial setting state.

The function switching keys 413 include a copy key, a transmission key and others being keys for mutually switching the copy function, the transmission function and other functions. If the copy key is manipulated, an initial picture of the copy is displayed in the display part 403. If the transmission key is manipulated, an initial picture of the facsimile transmission and an email transmission is displayed in the display part 403.

Figure 2:
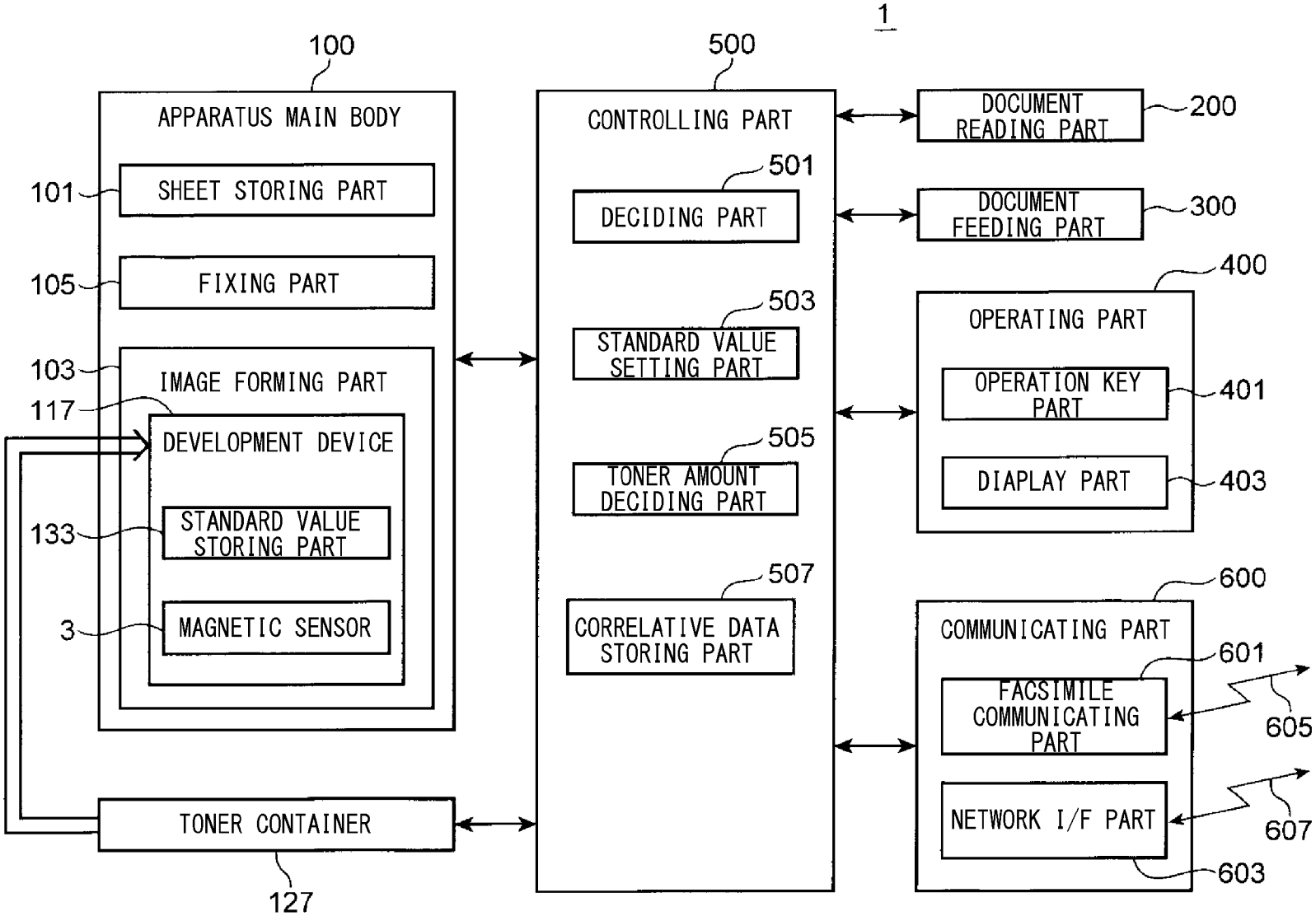
FIG. 2 is a block diagram showing a configuration of the image forming apparatus shown in FIG. 1 according to the embodiment of the present disclosure.

FIG. 2 is a block diagram showing a configuration of the image forming apparatus 1 shown in FIG. 1. The image forming apparatus 1 is configured so that the apparatus main body 100, a toner container 127, the document reading part 200, the document feeding part 300, the operating part 400, a controlling part 500 and a communicating part 600 are connected to each other by a bus or the like. Because the apparatus main body 100, the document reading part 200, the document feeding part 300 and the operating part 400 are described above, the description will be omitted in the following.

In the toner container 127, a toner with magnetism (hereinafter, called as a magnetic toner) being as the developer having magnetic mono-component is contained and the magnetic toner is replenished from the toner container 127 to the development device 117.

The controlling part 500 includes a CPU (Central Processing Unit), a ROM (Read Only Memory), a RAM (Random Access Memory), an image memory (not shown) and others. The CPU executes necessary control for running the image forming apparatus 1 to the above-mentioned components, such as the apparatus main body 100, of the image forming apparatus 1. The ROM stores necessary software for controlling the running of the image forming apparatus 1. The RAM is utilized for temporarily storing data generated in executing the software, for storing application software and for other processes. The image memory temporarily stores the image data (such as the image data outputted from the document reading part 200, the image data transmitted from the personal computer or the image data received by the facsimile).

The communicating part 600 includes a facsimile communicating part 601 and a network I/F part 603. The facsimile communicating part 601 has an NCU (Network Control Unit) controlling a connection to a destination facsimile via a telephone line and a modulating/demodulating circuit modulating and demodulating a facsimile communication signal. The facsimile communicating part 601 is connected to the telephone line 605.

The network I/F part 603 is connected to a LAN (Local Area Network) 607. The network I/F part 603 is a communication interface circuit executing a communication to a terminal device, such as the personal computer, connected to the LAN 607.

The controlling part 500 includes, as functional blocks, a deciding part 501, a standard value setting part 503, a toner amount deciding part 505 and a correlative data storing part 507. These blocks will be described later.

The development device 117 includes a magnetic sensor 3 and a standard value storing part 133. The standard value storing part 133 is actualized by a nonvolatile memory. The standard value storing part 133 will be described later.

The magnetic sensor 3 obtains an output value varying in accordance with an amount of the magnetic toner (a magnetic toner amount) in the development device 117. On the basis of the output value, a toner residual amount in the development device 117 is measured.

Figure 3:
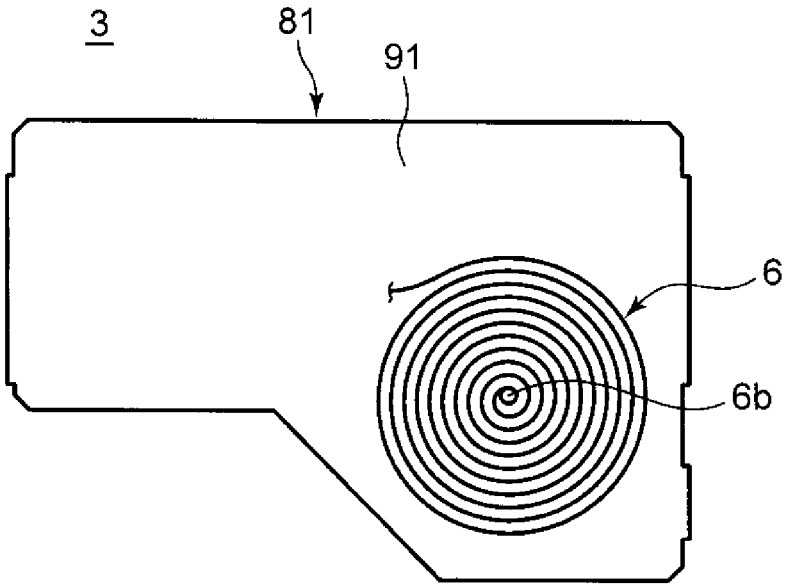
FIG. 3 is a plan view showing a first face on a substrate, in which a magnetic sensor is formed, arranged in the image forming apparatus according to the embodiment of the present disclosure.
Figure 4:
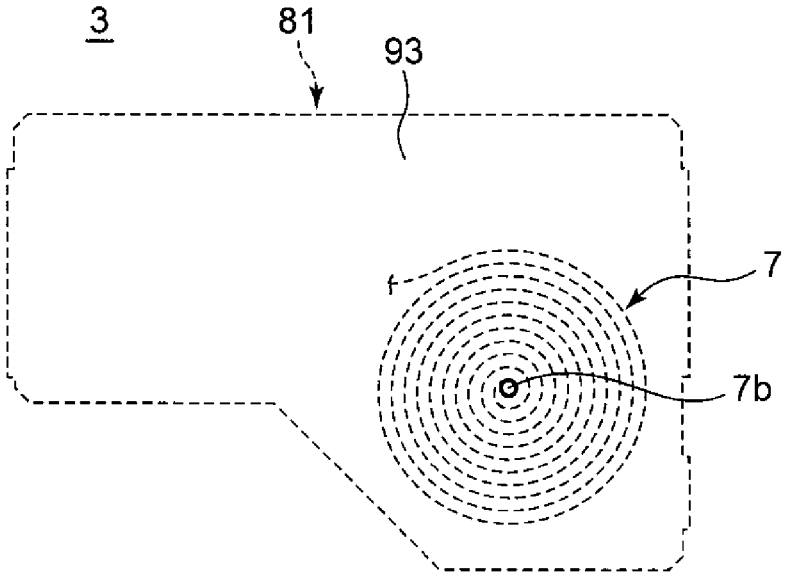
FIG. 4 is a plan view, as well as a perspective view of the substrate seen through from the first face side, showing a second face being an opposite face to the first face according to the embodiment of the present disclosure.
Figure 5:
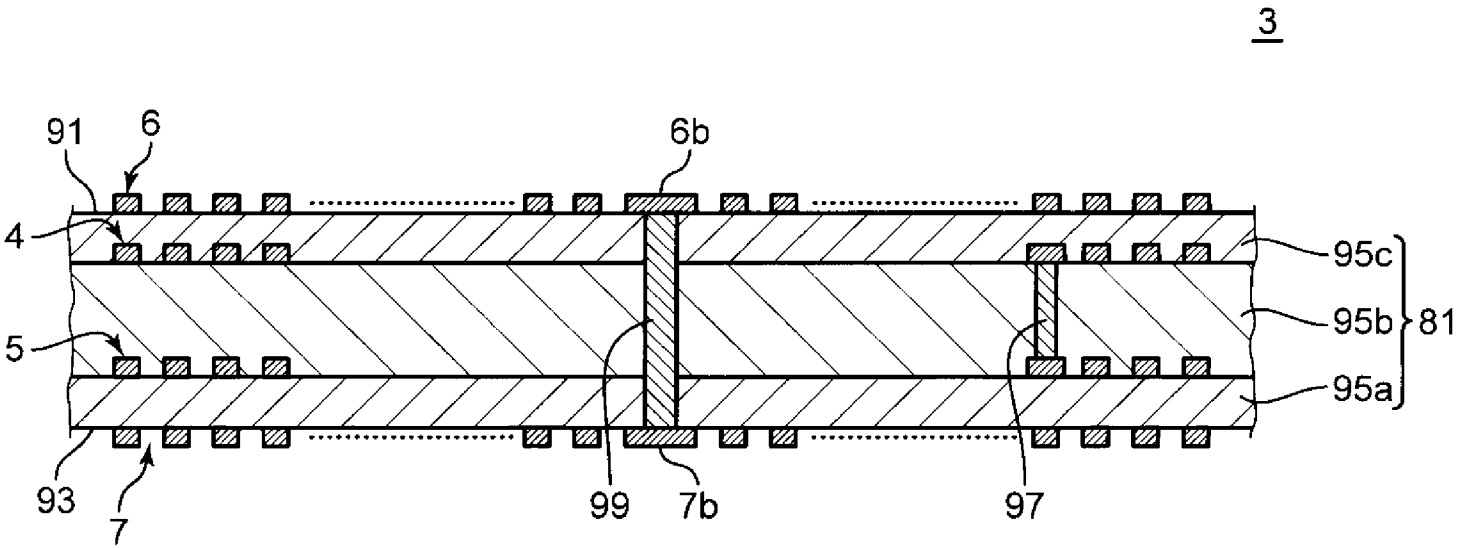
FIG. 5 is a sectional view showing a coil part of the magnetic sensor according to the embodiment of the present disclosure.

A configuration of the magnetic sensor 3 will be described in detail. FIG. 3 is a plan view showing a first face 91 on a substrate 81 in which the magnetic sensor 3 is formed. FIG. 4 is a plan view showing a second face 93 being an opposite face to the first face 91, as well as a perspective view of the substrate 81 seen through from the first face 91' side. FIG. 5 is a sectional view showing a coil part of the magnetic sensor 3.

The magnetic sensor 3 is a differential transformer-type permeability sensor to have a standard coil 6, a detection coil 7 and others.

With reference to FIG. 3, in the first face 91 of the substrate 81, the standard coil 6 is formed. The standard coil 6 is a plane coil having a structure patterning a wire material in a spiral form around a terminal 6*b* located at the center as a starting point.

With reference to FIG. 4, in the second face 93, the detection coil 7 is formed. The detection coil 7 is a plane coil having a structure patterning a wire material in a spiral form around a terminal 7*b* located at the center as a starting point.

With reference to FIG. 5, the substrate 81 has three-layered insulating layers, i.e. an insulating layer 95*a*, an insulating layer 95*b* located above the layer 95*a* and an insulating layer 95*c* located above the layer 95*b*.

On the first face 91 being as an upper face of the insulating layer 95*c*, the standard coil 6 is located. Between a lower face of the insulating layer 95*c* and an upper face of the insulating layer 95*b*, a first drive coil 4 is located. Between a lower face of the insulating layer 95*b* and an upper face of the insulating layer 95*a*, a second drive coil 5 is located. The first drive coil 4 and second drive coil 5 are plane coils having a structure patterning a wire material in a spiral form. In order that a magnetic flux generated by the first drive coil 4 and a magnetic flux generated by the second drive coil 5 become in the same direction when high frequency current is flowed in the first drive coil 4 and second drive coil 5, one end of the first drive coil 4 and one end of the second drive coil 5 are connected by using a connecting member 97. The connecting member 97 is embedded in a through hole formed in the insulating layer 95*b*.

On the second face 93 being as a lower face of the insulating layer 95*a*, the detection coil 7 is located. In order that a magnetic flux generated by the standard coil 6 and a magnetic flux generated by the detection coil 7 become in the opposite direction when induction current is flowed in the standard coil 6 and detection coil 7, one end of the standard coil 6 and one end of the detection coil 7 are connected by using a connecting member 99. The connecting member 99 is embedded in a through hole penetrating through the insulating layers 95*a*, 95*b* and 95*c*.

The magnetic sensor 3 detects the magnetic toner amount in the development device 117 on the basis of the induction current flowed in the standard coil 6 and detection coil 7.

Figure 6:
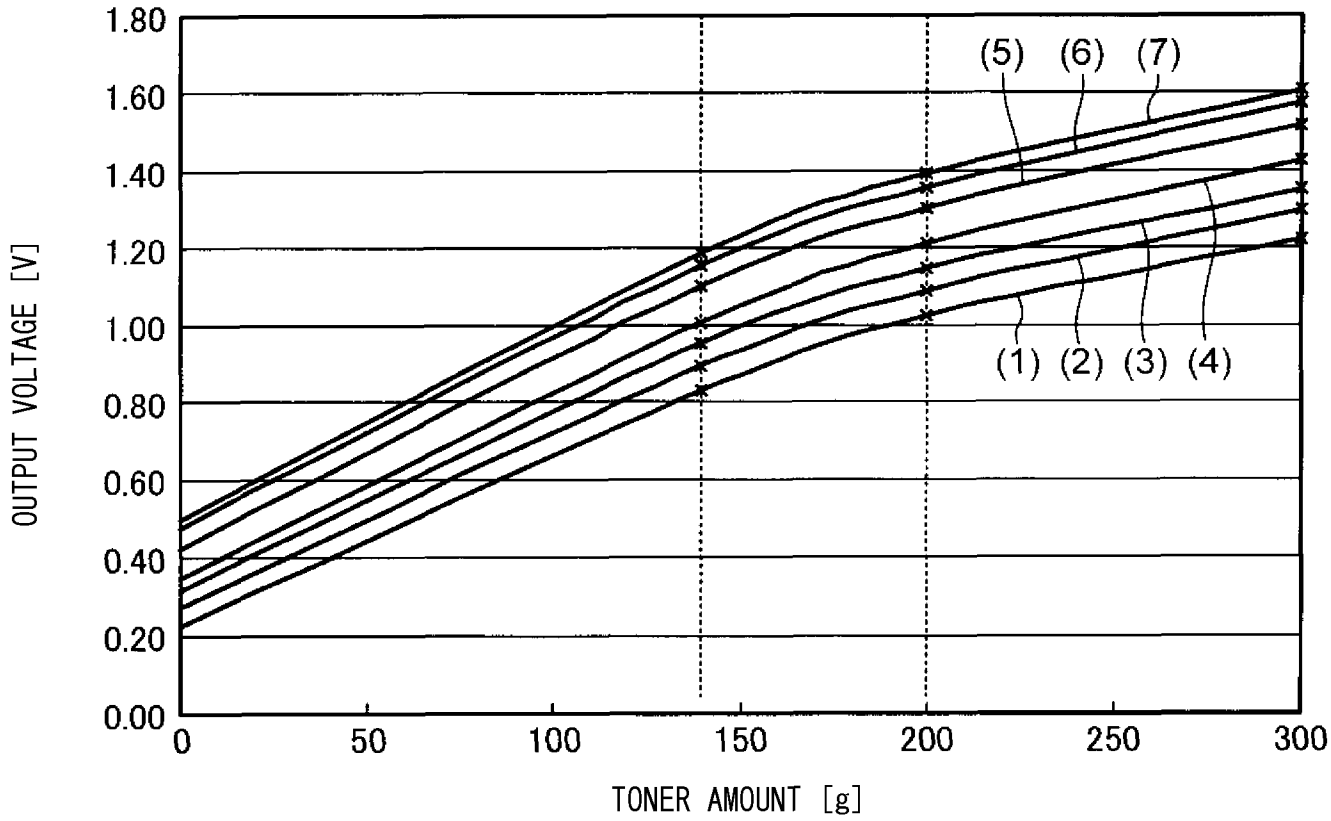
FIG. 6 is a graph showing a relationship between output voltage and an amount of a magnetic toner about a plurality of samples of the same product as the magnetic sensor arranged in the image forming apparatus according to the embodiment of the present disclosure.

FIG. 6 is a graph showing a relationship between output voltage and the magnetic toner amount about a plurality of samples of the same product as the magnetic sensor 3. A vertical axis of the graph indicates the output voltage of the magnetic sensor 3 and a horizontal axis of the graph indicates the magnetic toner amount in the development device 117. The output voltage indicates the output value outputted by the magnetic sensor 3. Because the magnetic toner is the mono-component developer, the magnetic toner amount indicates the residual amount of the magnetic toner in the development device 117.

By plotting the output voltages of the each sample when the magnetic toner amounts in the development device 117 are zero gram (i.e. a state that there is no magnetic toner in the development device 117), 140 grams, 200 grams and 300 grams, the graph showing the relationship between the output voltage and magnetic toner amount is created. Because the graph would be difficultly seen if all samples were graphed, seven samples (1)-(7) are graphed.

The graphs of the respective samples do not agree and dispersion occurs. This is because, even if the same products are applied, the dispersion of the output values inevitably occurs according to individual products.

The image forming part 103 as shown in FIG. 2 includes the development device 117 to control the magnetic toner amount in the development device 117 by a predetermined setting value, and simultaneously, to supply the magnetic toner from the development device 117 to the electrostatic latent image, thereby forming the toner image, and to form the toner image on the sheet. Thus, the development is executed by controlling the magnetic toner amount in the development device 117 by a predetermined setting value and the predetermined setting value is 200 grams here.

In a case where "the output voltage when the magnetic toner amount is zero gram" is indicated by a value x of a horizontal axis and "the output voltage when the magnetic toner amount is 200 grams" is indicated by a value y of a vertical axis, points indicated by the values x and y are plotted about all the samples having the seven samples, and then, on the basis of this, a regression line is determined. This regression line is shown in FIG. 7.

Figure 7:
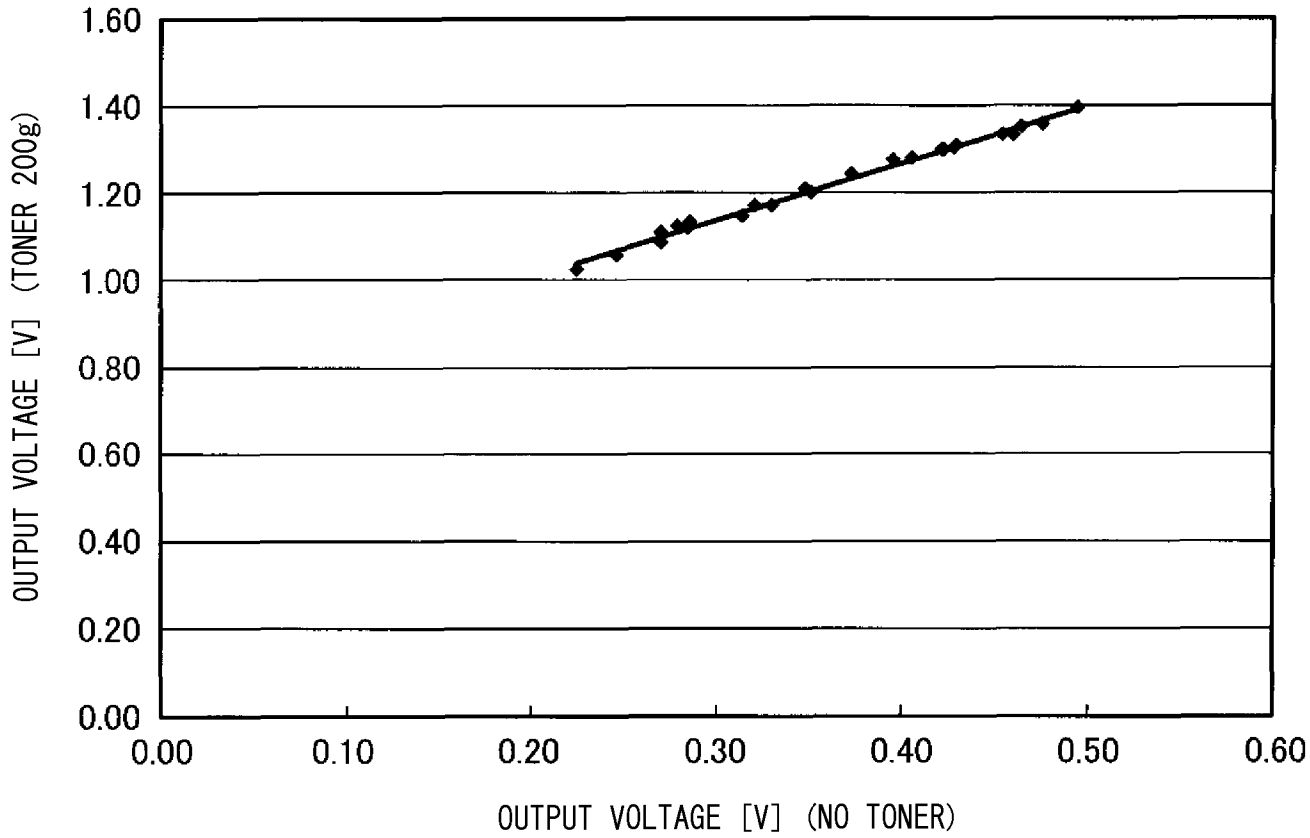
FIG. 7 is a graph showing a regression line, in a case where "an output voltage when the amount of the magnetic toner is zero gram" is indicated by a value x of a horizontal axis and "an output voltage when the amount of the magnetic toner is 200 grams" is indicated by a value y of a vertical axis, that is determined by plotting points indicated by the values x and y about a plurality of samples, according to the embodiment of the present disclosure.

In an example shown in FIG. 7, the regression line has a relationship indicated by a numerical expression of $y=1.3022x+0.7491$. This numerical expression is represented as a numerical expression of $y=1.30x+0.75$ by rounding off third decimal place. This numerical expression of $y=1.30x+0.75$ is an example of correlative data pre stored in the correlative data storing part 507 shown in FIG. 2.

The correlative data indicates a relationship of the output voltage outputted by the magnetic sensor 3 when there is no magnetic toner in the development device 117 and the output voltage outputted by the magnetic sensor 3 when the magnetic toner amount in the development device 117 is the predetermined setting value (200 grams in the embodiment). That is, the correlative data indicates a relationship of the output voltage outputted by the same product as the magnetic sensor 3 when there is no magnetic toner in the development device 117 and the output voltage outputted by the product when the magnetic toner amount in the development device 117 is the predetermined setting value.

Therefore, by using the numerical expression indicating the regression line and the output voltage outputted by the magnetic sensor 3 when the magnetic toner amount in the development device 117 is zero gram (i.e. there is no magnetic toner in the development device 117), it is possible to determine a standard value being as the output voltage outputted by the magnetic sensor 3 when the magnetic toner amount in the development device 117 is the predetermined setting value.

Here, the standard value storing part 133, deciding part 501, standard value setting part 503, toner amount deciding part 505 and correlative data storing part 507 as shown in FIG. 2 will be described.

The standard value storing part 133 stores the standard value being as the output value outputted by the magnetic sensor 3 when the magnetic toner amount in the development device 117 is the predetermined setting value and prestores an initial value of the standard value at a stage shipping the development device 117 from a factory.

The deciding part 501 decides whether or not the initial value is stored in the standard value storing part 133. If the deciding part 501 decides that the initial value is stored, the deciding part 501 decides the output value outputted by the magnetic sensor 3 as the output value outputted by the magnetic sensor 3 when there is no magnetic toner in the development device 117. In the correlative data storing part 507, the numerical expression indicating the above-mentioned regression line is prestored.

The standard value setting part 503 makes the standard value storing part 133 store the output value of the magnetic sensor 3 corresponding to the magnetic toner amount being the setting value, as new standard value, on the basis of the output value outputted by the magnetic sensor 3 when there is no magnetic toner in the development device 117 and the numerical expression indicating the above mentioned regression line (an example of the correlative data).

The toner amount deciding part 505 decides the magnetic toner amount in the development device 117 on the basis of the output value of the magnetic sensor 3 and the standard value.

Figure 8:
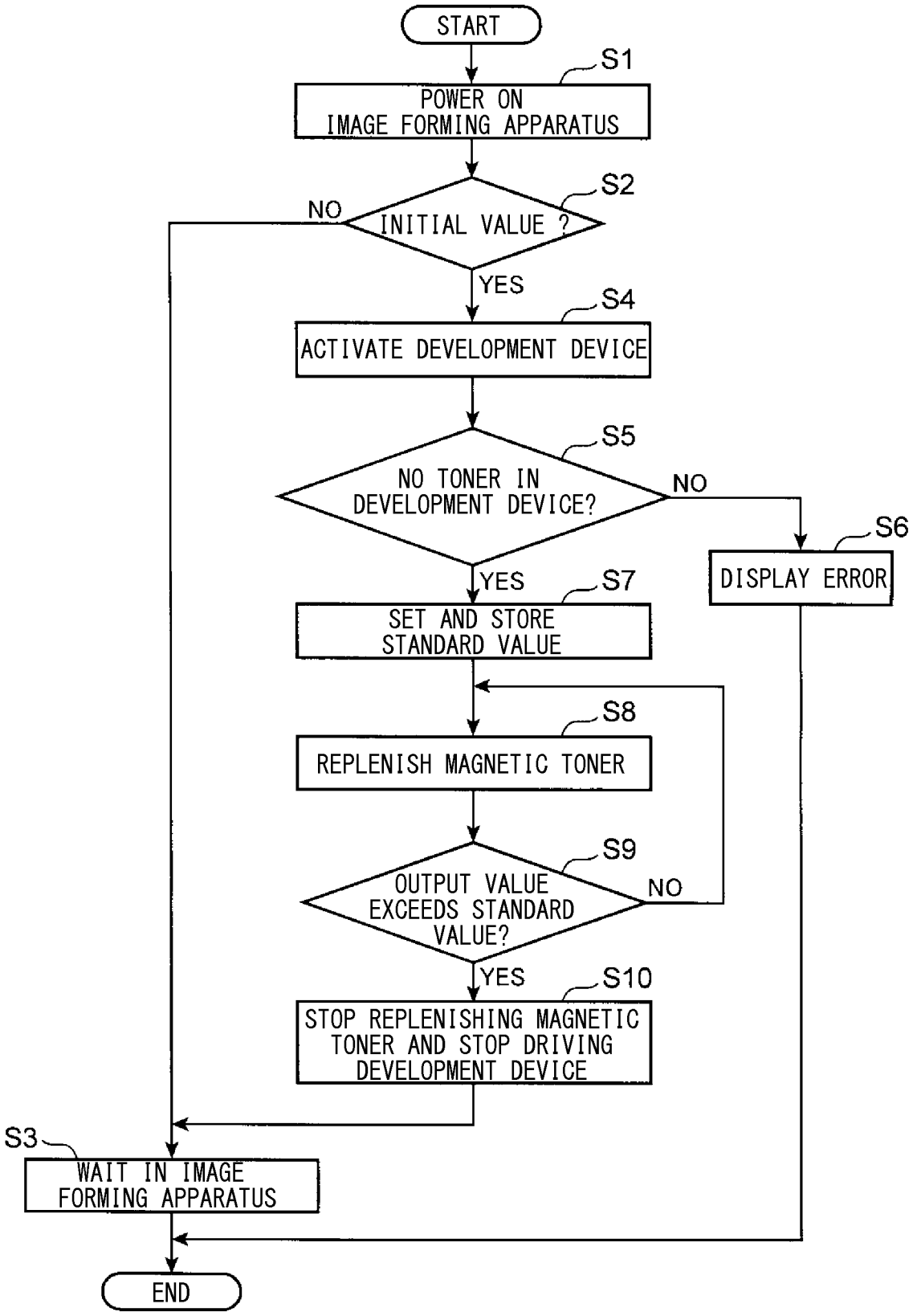
FIG. 8 is a flowchart used for explaining an operation replenishing the magnetic toner to a development device in a state that there is no magnetic toner in the image forming apparatus according to the embodiment of the present disclosure.

Next, an operation replenishing the magnetic toner to the development device 117 in a state that there is no magnetic toner (i.e. the development device 117 at factory shipping) about the image forming apparatus according to the embodiment will be described. FIG. 8 is a flowchart used for explaining this operation.

When a power switch of the image forming apparatus 1 is switched to an ON state, the power is supplied to the image forming apparatus 1 (step S1).

The deciding part 501 reads out the value stored in the standard value storing part 133 and decides whether or not it is the initial value (step S2). The development device 117 is one of units composing the image forming apparatus 1. When the development device 117 is shipped from the factory, in the standard value storing part 133 arranged in the development device 117, the initial value (e.g. zero) is stored.

When the deciding part 501 does not decide that the value stored in the standard value storing part 133 is the initial value (step S2: No), because the standard value storing part 133 already stores the standard value for correcting the dispersion of output characteristic of the magnetic sensor 3, the controlling part 500 controls so that the image forming apparatus 1 waits in a state being capable of the image forming (step S3).

When the deciding part 501 decides that the value stored in the standard value storing part 133 is the initial value (step S2: Yes), the controlling part 500 controls to drive the development device 117 so that the development device 117 can execute the development (step S4).

The deciding part 501 decides whether or not the output value outputted by the magnetic sensor 3 indicates that there is no magnetic toner in the development device 117 (step S5). If the output value is, for example, 0.5 V or less, it is assumed that there is no magnetic toner in the development device 117.

If the deciding part 501 does not decide that there is no magnetic toner in the development device 117 (step S5: No), the deciding part 501 decides that an error occurs. On the basis of this, the controlling part 500 controls the display part 403 to display an error indication (step S6). As cause of the error, there is a failure of the magnetic sensor 3.

If the deciding part 501 decides that there is no magnetic toner in the development device 117 (step S5: Yes), the standard value setting part 503 utilizes the numerical expression indicating the regression line (an example of the correlative data) shown in FIG. 7 prestored in the correlative data storing part 507 to set the standard value being the output value outputted by the magnetic sensor 3 when the magnetic toner amount in the development device 117 is 200 grams and to store it in the standard value storing part 133 (step S7).

Concretely, the standard value setting part 503 applies the output value obtained in the step S5, i.e. the output value outputted by the magnetic sensor 3 when there is no magnetic toner in the development device 117, as the value x to the numerical expression indicating the regression line of $y=1.30x+0.75$ to determine the value y. The value y is the output value outputted by the magnetic sensor 3 when the magnetic toner in the development device 117 is 200 grams, i.e. the standard value of the output value.

When the standard value is set and stored, the toner amount deciding part 505 controls to replenish the magnetic toner from the toner container 127 to the development device 117 (step S8).

The toner amount deciding part 505 decides whether or not the output value outputted by the magnetic sensor 3 exceeds the standard value set in step S7 (step S9). That is, the toner amount deciding part 505 decides whether or not the magnetic toner amount in the development device 117 exceeds 200 grams.

If the toner amount deciding part 505 does not decide the output value outputted by the magnetic sensor 3 exceeds the standard value (step S9: No), the toner amount deciding part 505 continues to replenish the magnetic toner to the development device 117 (step S8).

If the toner amount deciding part 505 decides the output value outputted by the magnetic sensor 3 exceeds the standard value (step S9: Yes), the toner amount deciding part 505 stops the control of replenishing the magnetic toner to the development device 117 and the controlling part 500 stops the drive of the development device 117 (step S10). Subsequently, the operation is advanced to step S3.

Main effects of the embodiment will be described. The discloser can find that the output value outputted by the magnetic sensor 3 when there is no magnetic toner in the development device 117 and the output value outputted by the magnetic sensor 3 when the magnetic toner amount in the development device 117 is the predetermined setting value have the correlative relationship in the same product. In detail, a difference between the output value outputted by the magnetic sensor 3 when there is no magnetic toner in the development device 117 and the output value outputted by the magnetic sensor 3 when the magnetic toner amount in the development device 117 is the predetermined setting value becomes even (or roughly even) among the same products.

As described with reference to FIG. 6, the difference between the output value outputted by the magnetic sensor 3 when there is no magnetic toner in the development device 117 and the output value outputted by the magnetic sensor 3 when the magnetic toner amount in the development device 117 is the predetermined setting value is equalized regardless of which of the samples (1)-(7).

on the basis of the fact that the above-mentioned difference is equalized among the samples, the regression line ($y=1.30x+0.75$) is determined in advance. Moreover, as described in step S7, the regression line and the output value outputted by the magnetic sensor 3 when there is no magnetic toner in the development device 117 are used for obtaining the output value of the magnetic sensor 3 corresponding to the magnetic toner amount being the setting value, and then, the initial value is replaced with the obtained output value and the obtained output value is stored as new standard value.

That is, in the development device 117 in a state that the magnetic toner is empty in factory shipping, by using the regression line and the output value outputted by the magnetic sensor 3 of the development device 117, the output value of the magnetic sensor corresponding to the magnetic toner amount being the setting value is obtained and stored as new standard value. By using the standard value, the magnetic toner amount in the development device 117 is controlled. Therefore, in accordance with the embodiment, it is possible to dispense with the adjustment of the output value of the magnetic sensor 3 when the magnetic toner amount in the development device 117 is controlled by the predetermined setting value.

In the embodiment, the differential transformer-type magnetic sensor with a plane coil system is used as the magnetic sensor 3. Because the differential transformer-type permeability sensor does not include a core, it is difficult to adjust the output value of the sensor with high accuracy. In accordance with the embodiment, as mentioned above, because it is unnecessary to adjust the output value of the magnetic sensor 3, a case of using the differential transformer-type magnetic sensor with the plane coil system as the magnetic sensor 3 is effectively applied in particular.

Because the numerical expression indicating the regression line is determined by using a plurality of the magnetic sensors being the same product, the numerical expressions are different among the different products. Moreover, because the standard value is determined for each magnetic sensor 3, even if the magnetic sensors 3 are the same product, the standard value is different according to the magnetic sensor 3.

In accordance with the embodiment, as shown in FIG. 2, the magnetic sensor 3 and standard value storing part 133 storing the standard value are arranged in the development device 117. Therefore, when the development device 117 is replaced, the magnetic sensor 3 and standard value storing part 133 are also replaced. Accordingly, it is possible to prevent from using another standard value set in another magnetic sensor 3 for controlling the magnetic toner amount.

A modified example of the embodiment will be described. In the modified example, an initial value of a zero standard value being an output value outputted by the magnetic sensor 3 when there is no magnetic toner in the development device 117 is prestored in the standard value storing part 133. That is, at the stage shipping the development device 117 from the factory, the standard value storing part 133 stores the initial value of the zero standard value in advance.

The deciding part 501 decides whether or not the initial value of the zero standard value is stored in the standard value storing part 133. If the deciding part 501 decides that the initial value of the zero standard value is stored in the standard value storing part 133, the standard value setting part 503 sets the output value outputted by the magnetic sensor 3 as the output value outputted by the magnetic sensor 3 when there is no magnetic toner in the development device 117 and makes the standard value storing part 133 store it as a new zero standard value.

When the zero standard value is stored instead of the initial value anew, the toner amount deciding part 505 determines the standard value as the output value of the magnetic sensor 3 corresponding to the magnetic toner amount being the setting value, about a case of the new zero standard value, by using the correlative data as shown in FIG. 7. Moreover, the toner amount deciding part 505 decides, in a similar way to the embodiment, the magnetic toner amount in the development device 117 on the basis of the output value of the magnetic sensor 3 and the standard value.

Main effects of the modified example will be described. The magnetic sensor 3 used as a toner sensor detects density of magnetic substance per unit volume around a sensing face of the magnetic sensor 3. The developer having the magnetic mono-component is composed of a magnetic toner and used by agitating this. By the agitation, air is inserted between particles of the magnetic toner. Therefore, in a case of the developer having the magnetic mono-component, a formula of (magnetic substance density)=(magnetic substance amount of magnetic toner)/(volume of magnetic toner+volume of air) is established. The magnetic sensor 3 is located so that the magnetic toner covering the sensing face of the magnetic sensor 3 is increased and decreased according to the magnetic toner amount in the development device 117. Because the air above the magnetic toner is increased when the magnetic toner is decreased, the magnetic substance density varies. Accordingly, it is possible to detect the magnetic toner amount.

When a common development device 117 is used in the image forming apparatuses being different in the number of the outputted sheets with same sheet size per minute (for example, an image forming apparatus outputting 30 sheets per minute and an image forming apparatus outputting 50 sheets per minute), they are different in the speed of a motor driving an agitation roller in the development device 117.

Therefore, among the image forming apparatuses being different in the number of the outputted sheets with same sheet size per minute, because they are different in an air amount inserted between particles of the magnetic toner, characteristics of the output voltages of the magnetic sensors 3 are slightly different.

The standard value used in the embodiment (that is, the standard value as the output value of the magnetic sensor 3 corresponding to the magnetic toner amount being the setting value) is not equalized among the image forming apparatuses being different in the number of the outputted sheets with same sheet size per minute. In other words, the correlative data shown in FIG. 7 is not equalized.

In the modified example, attention is paid to the fact that the output of the magnetic sensor 3 when there is no magnetic toner in the development device 117 is equalized among the image forming apparatuses being different in the number of the outputted sheets with same sheet size per minute. In accordance with the modified example, even if the development device 117 used for one image forming apparatus achieving a certain number of the outputted sheets is used for another image forming apparatus achieving another number of the outputted sheets, it is possible to use it without adjusting the output value of the magnetic sensor 3.

While the present disclosure has been described with reference to the preferable embodiment of the image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. An image forming apparatus comprising:

an image forming part, which includes a development device containing a magnetic toner, supplying the magnetic toner from the development device to an electrostatic latent image to form a toner image and forming the toner image on a sheet;

a magnetic sensor obtaining an output value varying in accordance with to a magnetic toner amount in the development device;

a correlative data storing part prestoring correlative data indicating a relationship of the output value outputted by the magnetic sensor when there is no magnetic toner in the development device and the output value outputted by the magnetic sensor when the magnetic toner amount in the development device is a predetermined setting value;

a standard value storing part prestoring an initial value of a standard value being the output value outputted by the magnetic sensor when the magnetic toner amount in the development device is the setting value;

a standard value setting part making the standard value storing part store the output value of the magnetic sensor corresponding to the magnetic toner amount being the setting value, as new standard value, on the basis of the output value outputted by the magnetic sensor when there is no magnetic toner in the development device and the correlative data; and a toner amount deciding part deciding the magnetic toner amount in the development device on the basis of the output value of the magnetic sensor and the standard value.

2. The image forming apparatus according to claim 1, wherein the magnetic sensor is a differential transformer-type permeability sensor having a substrate, a detection coil being a plane coil formed on one face of the substrate and a standard coil being a plane coil formed on another face of the substrate being at an opposite side to the one face.

3. The image forming apparatus according to claim 1, wherein the toner amount deciding part controls the magnetic toner amount in the development device by the setting value, when the magnetic toner is supplied from the development device to the electrostatic latent image to form the toner image.

4. The image forming apparatus according to claim 1 further comprising:

a deciding part deciding whether or not the initial value is stored in the standard storing part, and then, when deciding that the initial value is stored in the standard storing part, deciding the output value outputted by the magnetic sensor as the output value outputted by the magnetic sensor when there is no magnetic toner in the development device.

5. The image forming apparatus according to claim 1, wherein the magnetic sensor and standard value storing part is arranged in the development device.

6. An image forming apparatus comprising:

an image forming part, which includes a development device containing a magnetic toner, supplying the magnetic toner from the development device to an electrostatic latent image to form a toner image and forming the toner image on a sheet;

a magnetic sensor obtaining an output value varying in accordance with to a magnetic toner amount in the development device;

a correlative data storing part prestoring correlative data indicating a relationship of the output value outputted by the magnetic sensor when there is no magnetic toner in the development device and the output value outputted by the magnetic sensor when the magnetic toner amount in the development device is a predetermined setting value;

a standard value storing part prestoring an initial value of a zero standard value being the output value outputted by the magnetic sensor when there is no magnetic toner in the development device;

a standard value setting part making the standard value storing part store, as a new zero standard value, the output value outputted by the magnetic sensor when there is no magnetic toner in the development device; and a toner amount deciding part determining the standard value as the output value of the magnetic sensor corresponding to the magnetic toner amount being the setting value, about a case of the new zero standard value, by using the correlative data, and deciding the magnetic toner amount in the development device on the basis of the output value of the magnetic sensor and the standard value.

7. The image forming apparatus according to claim 6, wherein the magnetic sensor is a differential transformer-type permeability sensor having a substrate, a detection coil being a plane coil formed on one face of the substrate and a standard coil being a plane coil formed on another face of the substrate being at an opposite side to the one face.

8. The image forming apparatus according to claim 6, wherein the toner amount deciding part controls the magnetic toner amount in the development device by the setting value, when the magnetic toner is supplied from the development device to the electrostatic latent image to form the toner image.

9. The image forming apparatus according to claim 6 further comprising:

a deciding part deciding whether or not the initial value is stored in the standard storing part, and then, when deciding that the initial value is stored in the standard storing part, deciding the output value outputted by the magnetic sensor as the output value outputted by the magnetic sensor when there is no magnetic toner in the development device.

10. The image forming apparatus according to claim 6, wherein the magnetic sensor and standard value storing part is arranged in the development device.

* * * * *